US006035485A

United States Patent [19]

Holsten

[11] Patent Number: 6,035,485

[45] Date of Patent: Mar. 14, 2000

[54] VACUUM CLEANER MUFFLER/ DEFLECTOR

[75] Inventor: Stuart V. Holsten, O'Fallon, Mo.

[73] Assignee: Emerson Electric Co., St. Louis, Mo.

[21] Appl. No.: 09/045,071

[22] Filed: Mar. 20, 1998

[51] Int. Cl.[7] ..... A47L 9/00

[52] U.S. Cl. ..... 15/326; 15/353

[58] Field of Search ..... 15/326, 353; 96/382, 96/388; 181/256

[56] References Cited

U.S. PATENT DOCUMENTS

| | | | |
|---|---|---|---|
| 2,253,310 | 8/1941 | Smellie . | |
| 2,328,236 | 8/1943 | Stoner . | |
| 3,115,209 | 12/1963 | Bembinster | 181/256 |
| 3,759,157 | 9/1973 | Larkfeldt | 181/256 |
| 3,973,642 | 8/1976 | Dahlquist | 15/326 |
| 4,015,683 | 4/1977 | Williams . | |
| 4,867,270 | 9/1989 | Wissmann et al. . | |
| 5,075,610 | 12/1991 | Harris . | |
| 5,517,716 | 5/1996 | Park . | |
| 5,765,257 | 6/1998 | Steger et al. | 15/326 |

FOREIGN PATENT DOCUMENTS

| | | |
|---|---|---|
| 4418433 | 12/1994 | Germany . |
| 3-295525 | 12/1991 | Japan . |

*Primary Examiner*—Terrence R. Till
*Attorney, Agent, or Firm*—Arnold White & Durkee; Mark L. Gleason

[57] ABSTRACT

A combined muffler and air deflector apparatus for a vacuum cleaner includes a body having first and second ends, the first end adapted to be coupled to a blower port of a vacuum cleaner. A cap has a first end that defines an outlet, and a second end that is coupled to the second end of the body so that the body and the cap define a passageway for directing air from the blower port to the outlet. The outlet may be generally tapered such that air flowing through the passageway from the blower port is restricted. A device is situated in the passageway for muffling sound. In one embodiment, the sound muffling device comprises a divider that creates sound reflecting chambers. In another embodiment, an acoustical pad functions as the sound muffling device.

39 Claims, 9 Drawing Sheets

VACUUM CLEANER MUFFLER/ DEFLECTOR

BACKGROUND OF THE INVENTION

1. Field of the Invention

The invention relates generally to sound mufflers and discharge air deflection devices for vacuum cleaners. More particularly, the invention relates to a combined muffler and air deflector apparatus that reduces vacuum cleaner noise and directs discharge air as desired by a user.

2. Description of the Related Art

A common problem with vacuum cleaners, and especially wet/dry vacs, is the excessive and irritating noise generated by the vacuum cleaner. The vacuum motor itself generates noise, and in vacuum cleaners having blowing ports, such as wet/dry vacs, the high-velocity air exiting the blowing port further creates an especially annoying high-pitched "whine."

Existing vacuum cleaner muffler devices have been largely unsatisfactory. First, in the process of muffling the sound, they often severely reduce air suction performance. Further, existing vacuum cleaner mufflers are often large, clumsy devices filled with sound reduction foam. Often, the sound reducing foam is configured in irregular shapes requiring complicated cutting operations during the manufacturing process, adding cost and increasing waste. Alternatively, some known vacuum cleaner mufflers include multiple complicated chambers for reversing air flow, further degrading air flow performance.

Another problem associated with vacuum cleaners having blowing, or discharge ports, is the discharge air blowing in an unwanted direction or location. For example, many wet/dry vacs include a blowing port to which accessories may be coupled. With wet/dry vacs such as these, the discharge air from the blowing port can create several dilemmas when attempting to operate the machine. The discharge air may blow objects off the user's workplace, or the discharge air may blow media, such as dust and dirt, into the air, making it nearly impossible to completely vacuum up. Moreover, discharge air can create a nuisance, blowing onto the user or other bystanders.

Air deflecting devices are known in the art; however, prior art deflectors often do not allow the user to selectively direct the discharge air in a desired direction. Further, they often take up excessive space around the perimeter of the vacuum cleaner. Still further, known deflectors do not provide sound reducing capabilities.

Thus, a need exists for a combined sound reducing and air directing device that addresses shortcomings of the prior art.

SUMMARY OF THE INVENTION

In one aspect of the present invention, a muffler and air deflector apparatus for a vacuum cleaner includes a body having first and second ends, with the first end being adapted to be coupled to a blower port of a vacuum cleaner. A cap has first and second ends, with the first end defining a tapered outlet, and the second end coupled to the second end of the body such that the body and the cap define a passageway for directing air from the blower port to the outlet. A device is situated in the passageway for muffling sound.

In another aspect of the invention, a muffler and air deflector apparatus for a vacuum cleaner includes a body having first and second ends, with the first end being adapted to be coupled to a blower port of a vacuum cleaner. A cap has first and second ends, with the first end defining an outlet, and the second end being coupled to the second end of the body such that the body and the cap define a passageway for directing air from the blower port to the outlet. A divider is seated within the passageway such that the passageway and the divider define at least one sound wave reflecting chamber.

In a further aspect of the invention, a muffler and air deflector apparatus for a vacuum cleaner includes a body having first and second ends. The first end is adapted to be coupled to a blower port of a vacuum cleaner. A cap includes first and second ends, with the first end defining an outlet, and the second end being coupled to the second end of the body such that the body and the cap define a passageway for directing air from the blower port to the outlet. A generally rectangular-shaped acoustic pad is rolled into a tube defining a smooth inner bore and situated axially within the passageway.

In yet another aspect of the invention, a method for assembling a muffler and air deflector device for a vacuum cleaner includes rolling an acoustical pad approximately into a tube, slipping the rolled acoustical pad into a first channel in an end of a body member, the end defining a locking slot, and pushing a cap member defining a second channel and including a locking tab over the body member end such that the seats within the second channel and the locking tab snaps into the locking slot.

In a still further aspect of the invention, a method for assembling a muffler and air deflector device for a vacuum cleaner includes seating a divider in an end of a cap member and placing a body member over the end of the cap member in a manner such that the divider is trapped between the body member and the cap member. The body member is pushed against the cap member until a locking tab defined by the cap member snaps into a locking slot defined by the body member.

BRIEF DESCRIPTION OF THE DRAWINGS

Other objects and advantages of the invention will become apparent upon reading the following detailed description and upon reference to the drawings in which.

Figure 1:
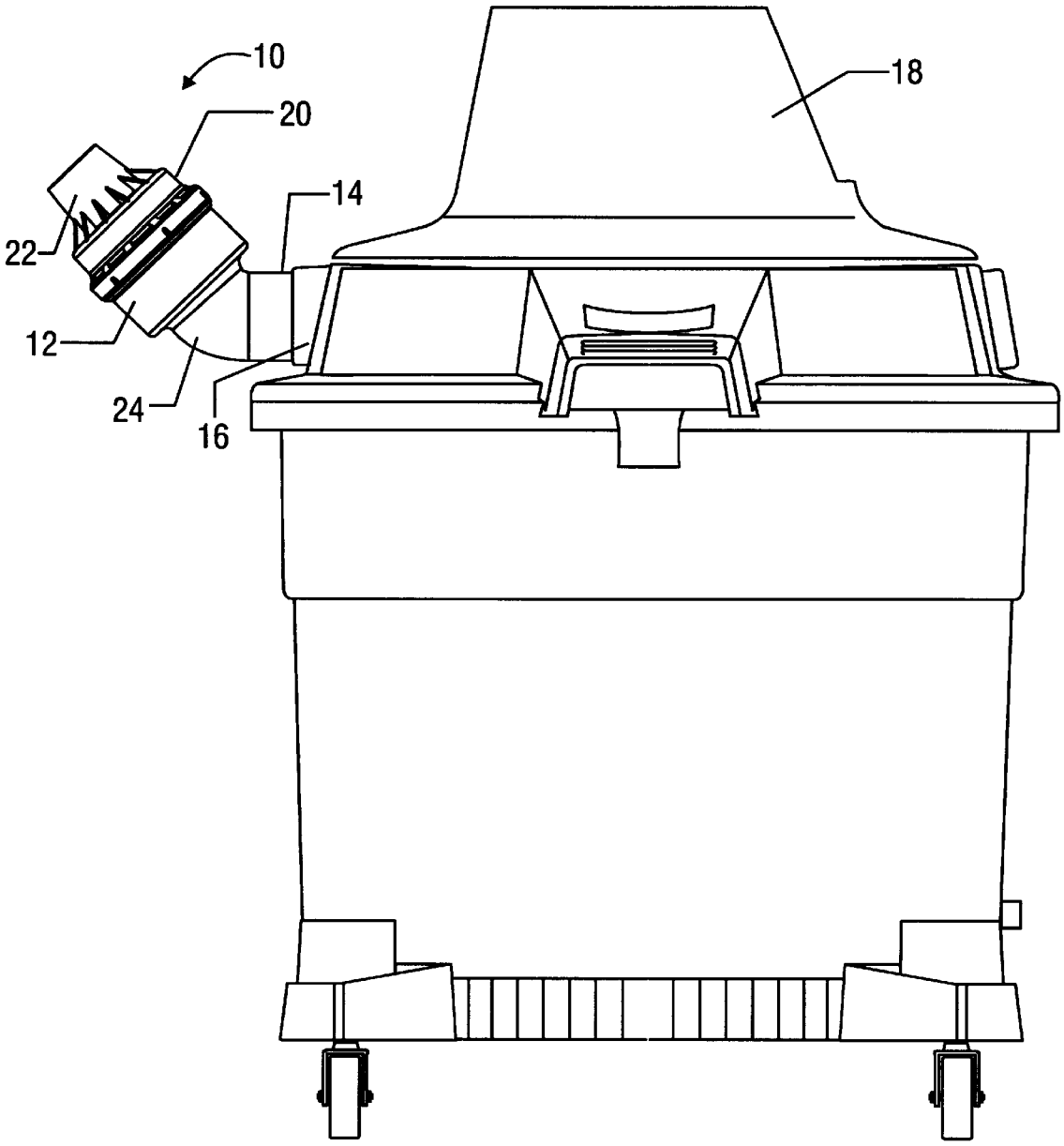
FIG. 1 illustrates an embodiment of a muffler/deflector in accordance with the invention coupled to a blower port of a wet/dry vac.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

FIG. 1 illustrates an embodiment of a muffler and air deflector apparatus for a vacuum cleaner in accordance with the present invention. In general, the muffler/deflector 10 includes a body 12 having one end 14 adapted to be coupled to a blower port 16 of a vacuum cleaner 18, such as a wet/dry vac. In one embodiment, the body 12 is adapted to be coupled to a wet/dry vac 18 blower port 16 for 2.5 inch diameter accessories. The other end of the body 12 is coupled to one end of a cap 20, such that the body 12 and the cap 20 define a passageway for directing air from the blower port 16 to the outlet 22.

The cap 20 and the body 12 may be adapted to be coupled together via a snap-fit, simplifying the assembly process and eliminating the need for fasteners or special tooling. To simplify assembly even further, the cap 20 and body 12 may be configured as a non-directional assembly, such that the cap 20 does not have to clock or locate in a certain orientation relative to the body 12, so that the cap 20 may be placed at any location 360° with respect to the body 12 and snapped thereto.

The outlet 22 may be generally tapered such 1hat air flowing through the passageway from the blower port 16 is slightly restricted to reduce some of the sound of the high velocity air flowing through the muffler/deflector 10 from the blower port 16. Additionally, a device (not shown in FIG. 1) is situated in the passageway for further muffling sound.

The end 14 of the muffler/deflector 10 may be rotatably coupled to the blower port 16. In other words, the muffler/deflector 10 may be rotated about the blower port 16. In one embodiment, the end 14 is a round male end that is adapted to plug into the round female end of the wet/dry vac 18 blower port 16. Further, the body 12 may be substantially rigid, and be arranged such that the passageway defines a nonlinear air passage from the blower port 16 to the outlet 22. For example, the body 12 may include an elbow 24 so that the discharge air does not travel in a straight line from the blower port 16 to the outlet 22. In one embodiment of the invention, the elbow 24 defines an angle of about 45°, so that the discharge air is deflected about 45°. The 45° bend provides adequate clearance of the muffler/deflector 10 to the wet/dry vac 18, while not excessively restricting the air flow through the muffler/deflector 10. A more severely angled elbow 24 (for example, a 90° bend) takes up additional room perpendicular to the blower port 16, as compared to the same length of a 45° muffler/deflector 10.

Thus, the muffler/deflector 10 may be rotated about the blower port 16, allowing discharge air from the blower port 16 to be deflected in a desired direction. The ability to rotate the angled muffler/deflector 10 about the blower port 16 provides several benefits to a user of the vacuum cleaner 18. For example, air can be directed in a manner to prevent discharge air from blowing objects off the user's , workplace, to prevent blowing dust and dirt that the user is attempting to vacuum into the air, or to prevent blowing air on the users or other bystanders and creating a nuisance.

Figure 2:
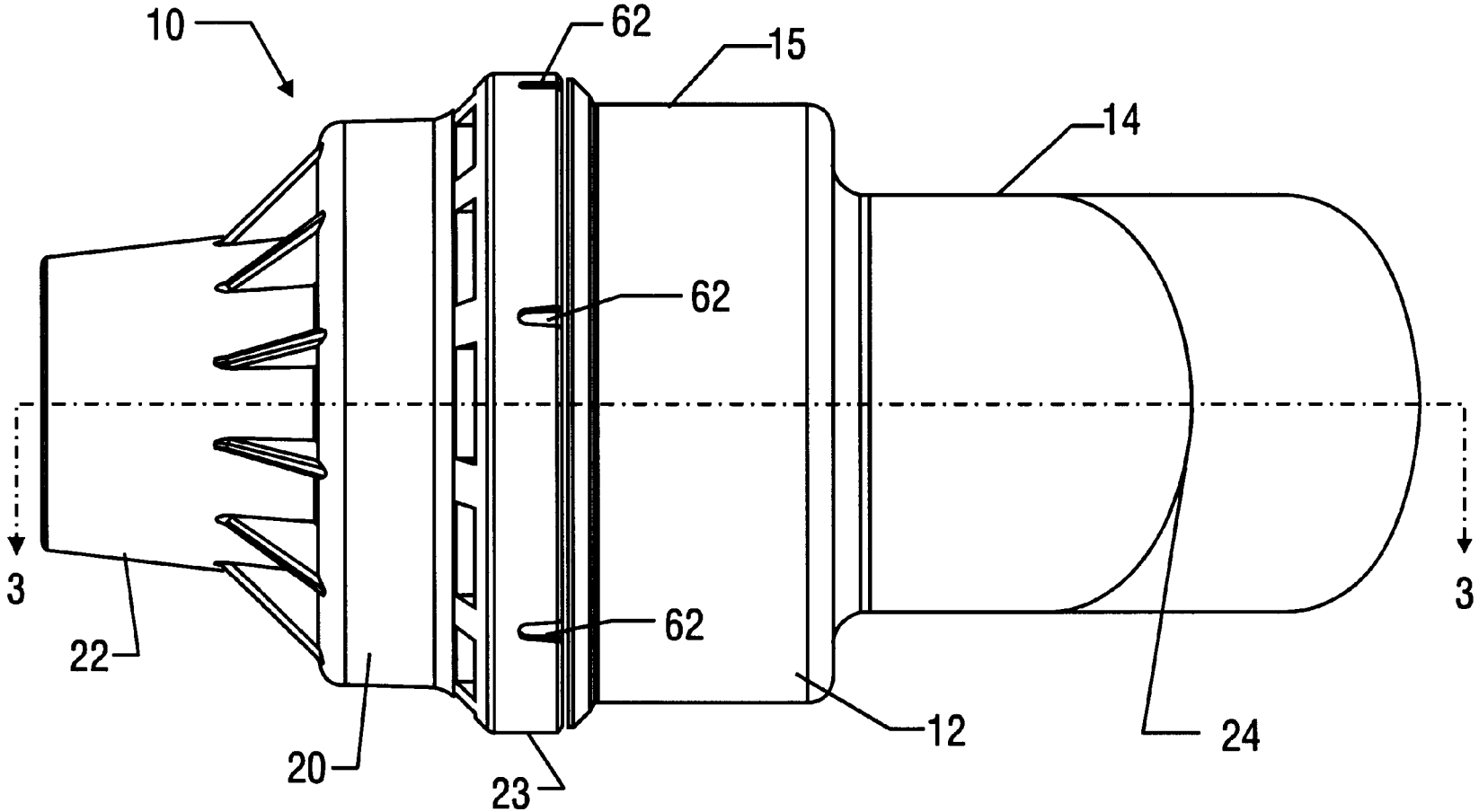
FIG. 2 illustrates an exemplary muffler/deflector in accordance with a first embodiment of the present invention.
Figure 3:
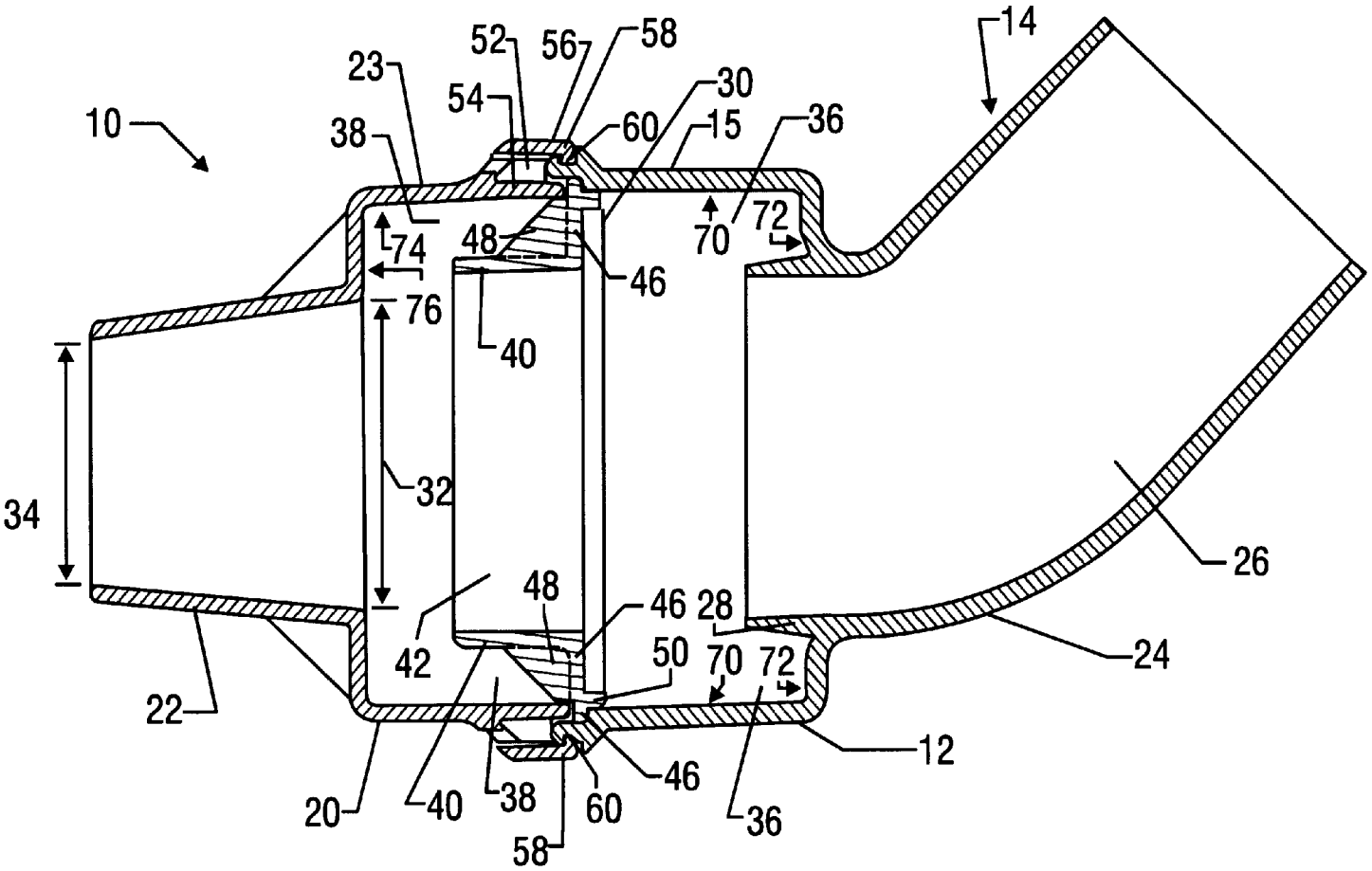
FIG. 3 is a section view of the embodiment of the muffler/deflector shown FIG. 2, taken along line 3—3.
Figure 4:
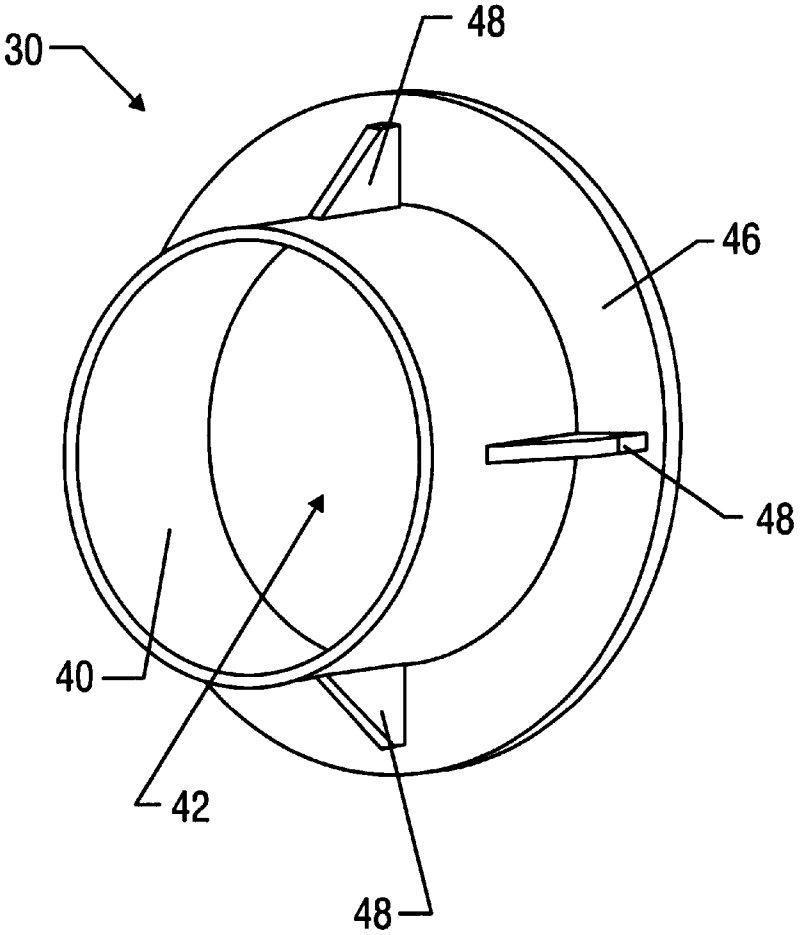
FIG. 4 is a perspective view of an exemplary divider in accordance with the first embodiment of the invention.
Figure 5A:
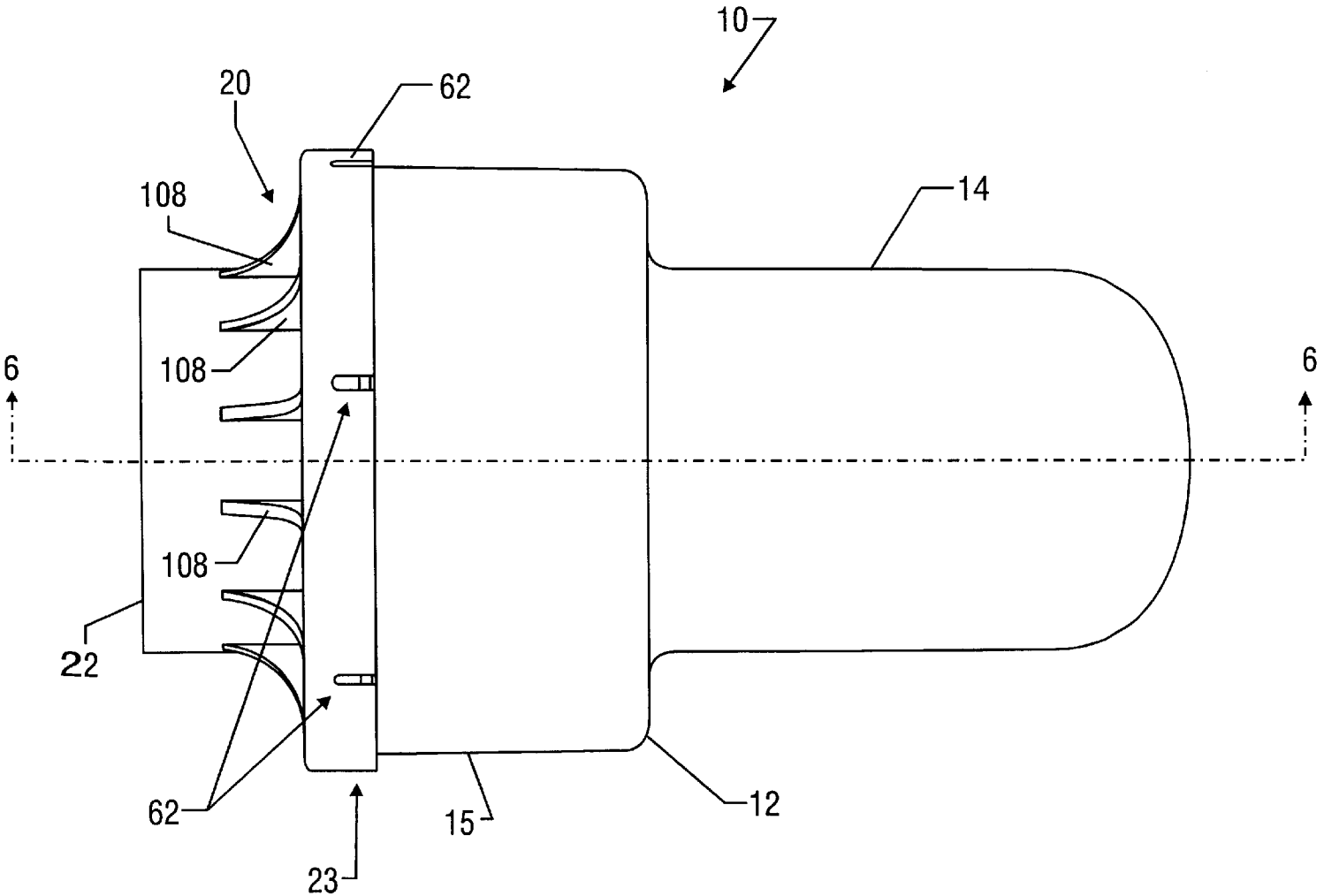
FIG. 5A illustrates an exemplary muffler/deflector in accordance with a second embodiment of the present invention.
Figure 5B:
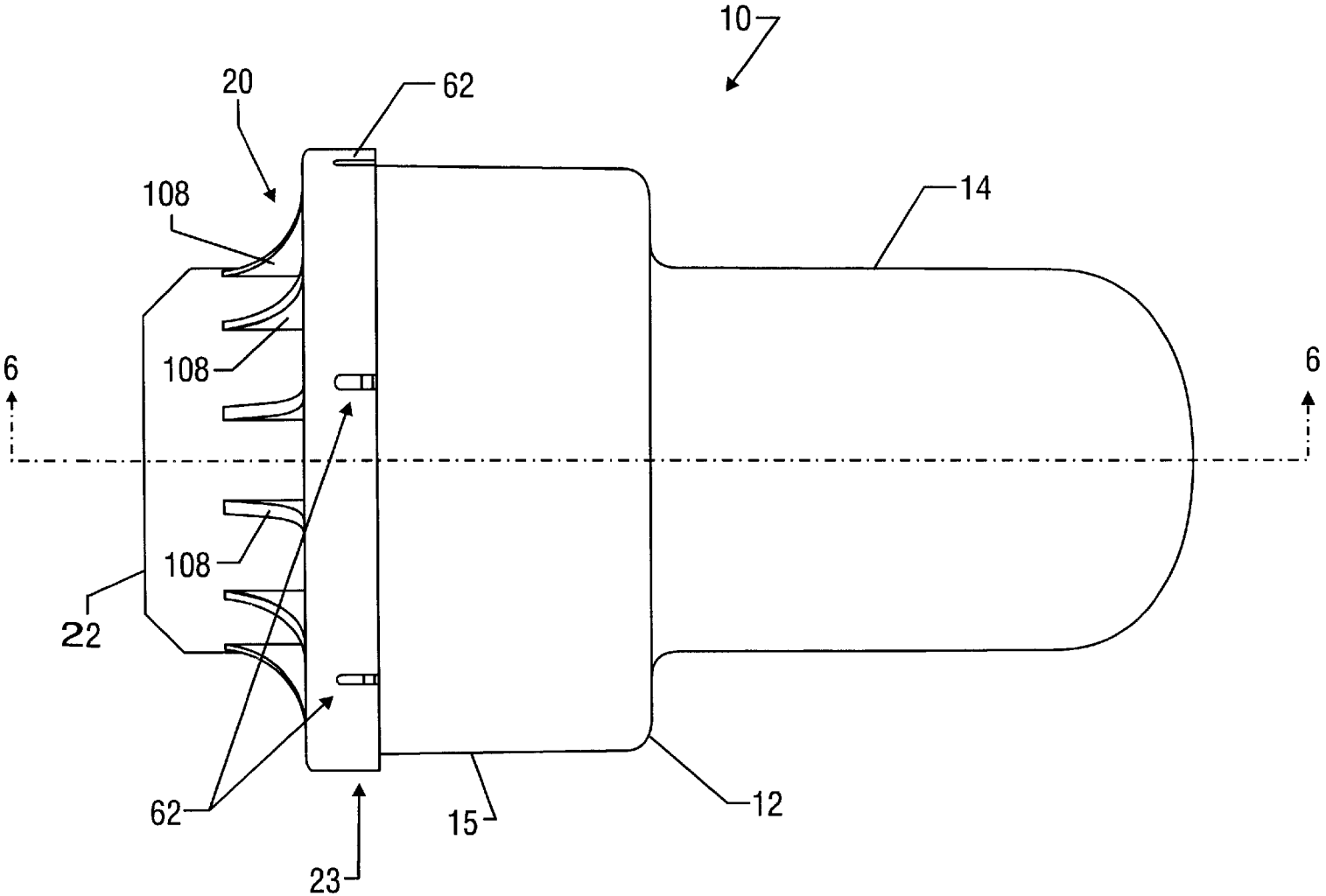
FIG. 5B illustrates an alternative version of the muffler /deflector shown in FIG. 5A.
Figure 6:
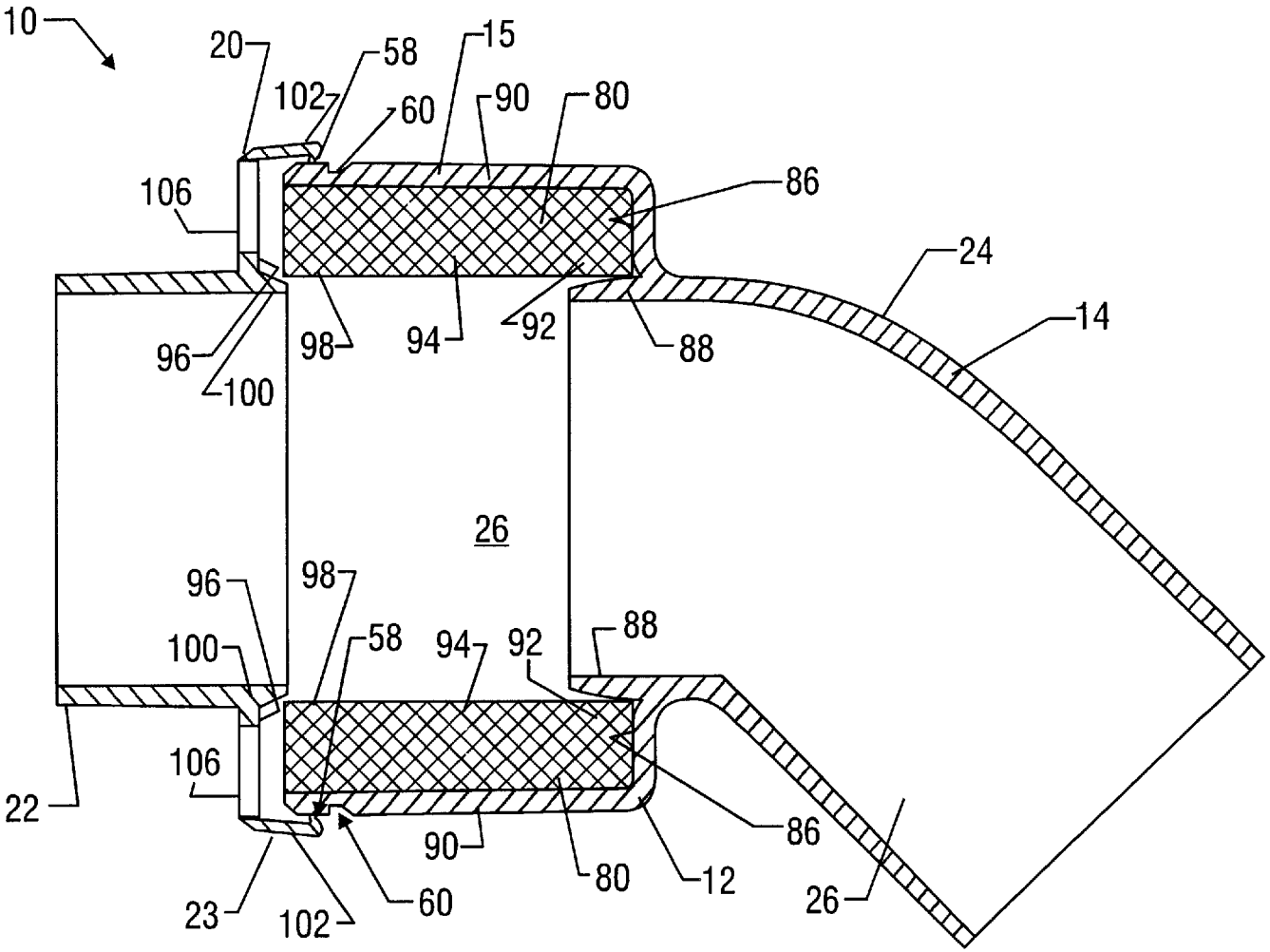
FIG. 6 is a section view of the muffler/deflector illustrated in FIG. 5, taken along line 6—6, illustrating the cap deflecting over the body.

FIG. 2, FIG. 3 and FIG. 4 illustrate a muffler/deflector 10 in accordance with a first embodiment of the present invention. FIG. 2 shows a plan view of the muffler/deflector 10, and FIG. 3 is a sectional view taken along line 3—3 of FIG. 2. A first end 14 of the body 12 is adapted to be coupled to a vacuum cleaner, such as the wet/dry vac 18 of FIG. 1. The first end 14 further defines an elbow 24, such that the passageway 26 is nonlinear to direct the discharge air in a particular direction. In a particular embodiment, the elbow 24 defines a 45° angle. Still further, the first end 14 of the body 12 defines a flange 28 that extends into the second end 15 of the body 12.

The cap 20 includes a first end defining an outlet 22, with a second end 23 of the cap 20 coupled to the second end 15 of the body 12 such that the body 12 and the cap 20 define a passageway 26 for directing air from the blower port 16 to the outlet 22. A divider 30 is seated in the passageway 26 such that the passageway 26 and the divider 30 define at least one sound wave reflecting chamber. The body 12, cap 20 and divider 30 may all be injection molded out of polypropylene plastic.

The outlet 22 defines a first inside diameter 32 that is greater than a second inside diameter 34. Hence, the outlet 22 is tapered, or generally funnel shaped. The funnel shape restricts airflow slightly to reduce some of the sound of the high velocity air discharging out of the muffler/deflector 10. In a particular embodiment of the muffler/deflector adapted for use with a wet/dry vac having a blower port for 2.5 inch accessories, the first inside diameter 32 is about 1.9 inches, and the second inside diameter 34 is about 1.5 inches. While the tapered outlet 22 reduces some of the vacuum cleaner noise, it may not eliminate the high-pitched "whine" inherent with many wet/dry vacs. The divider 30, seated within the passageway 26 further reduces this high pitched noise.

FIG. 4 illustrates an exemplary divider 30 in accordance with the first embodiment of the present invention. The divider 30 creates first and second reflection chambers 36, 38 in the passageway 26 that reflect the high pitched noise back to the source. The divider 30 includes a cylindrical flange 40 that defines a bore 42 therethrough generally coaxial with the cap 20. The divider 30 is seated within the passageway 26 such that at least a portion of the flange 40 extends into the cap 20. The flange 40 may further include a shoulder portion 46, which in one embodiment, defines a plane that is oriented generally transverse to the axis of the bore 42. Alignment ribs 48 between the shoulder 46 and flange 40 and a rib 50 extending generally opposite the flange 40 are provided to simplify assembly of the muffler/deflector 10.

When a muffler/deflector 10 in accordance with the first embodiment of the invention is assembled, the divider 30 is first set into the cap 20, with the flange 40 extending into the cap 20. The divider 30 self aligns with the cap 20, for ease of assembly, with the aid of the alignment ribs 48. Further, the rib 50 extending in a direction opposite the flange 40 is adapted such that it fits into the body 12, but not into the cap 20. As illustrated in FIG. 3, the rib 50 defines a diameter that is larger than the inside diameter of the second end 23 of the cap 20. Thus, the rib 50 assures that the divider 30 is in the correct orientation, as the rib 50 prevents the divider 30 from being positioned such that the flange 40 extends into the body 12, rather than the cap 20. After the divider 30 is seated within the cap 20, the body 12 is pushed against the cap 20, trapping a portion of the shoulder 46 between the cap 20 and the body 12 to hold the divider 30 in a fixed position.

The end of the cap 20 that is coupled to the body 12 defines a channel 52 about its periphery. The channel 52 includes inner and outer concentric walls 54, 56, with the outer wall 56 defining a plurality of locking tabs 58. The corresponding end of the body 12 defines a corresponding locking slot 60 about its periphery. To couple the cap 20 and body 12 together, the body is pushed into the channel 52, such that the channel 52 outer wall 56 deflects until the locking tabs 58 engage the locking slot 60. The body 12 is not required to be in any particular rotational position relative to the cap 20. The cap 20 defines a plurality of relief slots 62 therethrough to facilitate the deflecting of the cap 20 over the body 12, without permanently deforming the cap 20. The inner and outer walls 54, 56 may each be angled to assist in aligning the body 12 with the cap 20 during the assembly process. Thus, a simple snap-coupling is provided, eliminating the need for fasteners or special tooling. Other snap-coupling arrangements are envisioned, such as providing a positive tab on the body 12, rather than the negative slot 60, that the locking tabs 58 could snap over.

The first sound reflecting chamber 36 is located generally within the body 12, and the second chamber 38 is located within the cap 20. The first reflecting chamber 36 is generally defined by an inside surface 70 of the body second end 15 generally parallel to the air flow therethrough, the flange 28 extending from the body first end 14 into the second end 15, the divider shoulder 46, and an inside surface 72 of the body second end 15 approximately normal to the air flow therethrough.

The second sound reflecting chamber 38, located in the cap 20, is defined by an inside surface 74 of the cap second end 23 generally parallel to the air flow therethrough, the flange 40 extending from the divider 30, the divider shoulder 46, and an inside surface 76 of the cap second end 23 approximately normal to the air flow therethrough. The first sound reflecting chamber flange 28 and the second sound reflecting chamber flange 40 direct the air flowing through the muffler/deflector 10, assisting in the sound reflection function and reducing the sound of the high velocity air. To further muffle the sound, the surfaces normal to the air flow (surfaces 72, 76 and the shoulder 46) should be oriented as close to perpendicular to the air stream as possible, to achieve maximum sound wave reflection back to the source and prevent as many sound waves from exiting via the outlet 22 as possible.

In a particular embodiment of the muffler/deflector adapted for use with a wet/dry vac having a blower port for 2.5 inch accessories, the inside surfaces 70, 74 parallel to the air flow define diameters of about 3.1 inches. The bore 42' extending through the flange 40 defines an inside diameter of about 2.2 inches, and the flange 28 defines an inside diameter of about 2.1 inches. The body second end 15 is arranged such that the shoulder 46 is positioned about 1.3 inches from the body inside surface 72 when the divider 30 is fixed between the cap 20 and the body 12, and the flange 28 extends about 0.3 inches into the body second end 15. In a similar manner, the cap 20 is arranged such that the inside surface 76 is about 1.2 inches from the shoulder 46, and the divider flange 40 extends about 0.7 inches into the cap.

Sound and air flow performance was tested on a muffler/deflector 10 in accordance with the first embodiment of the invention, configured as described above, with wet/dry vac machines having blower ports. Sound levels were checked with the wet/dry vac inlet wide open and with the inlet blocked (blocked suction). With the muffler/deflector 10 coupled to the blower port, significant sound reduction was achieved while only minimally reducing air flow. In addition to reducing sound power, the muffler/air deflector 10 reflects and reduces some of the irritating pitches, making the sound more tolerable.

Sound and air flow performance was tested on a muffler/deflector 10 in accordance with the first embodiment of the invention, configured as described above, with wet/dry vac machines having blower ports. Sound levels were checked with the wet/dry vac inlet wide open and with the inlet blocked (blocked suction). With the muffler/deflector 10 coupled to the blower port, significant sound reduction was achieved while only minimally reducing air flow. In addition to reducing sound power, the muffler/air deflector 10 reflects and reduces some of the irritating pitches, making the sound more tolerable.

A muffler/deflector 10 in accordance with a second embodiment of the present invention is illustrated in FIG. 5 through FIG. 8. The muffler/deflector 10 of the second embodiment includes a body 12 having a first end 14 adapted to be coupled to a blower port of a vacuum cleaner, such as the wet/dry vac 18 of FIG. 1, such that the body is rotatable about the blower port. The first end 14 is substantially rigid, and includes an elbow that may define a 45° bend. The cap 20 includes a first end that defines a generally cylindrical outlet 22, and the cap second end 23 is coupled to a second end 15 of the body 12 such that the body and the cap define a nonlinear passageway 26 for directing air. FIG. 5B illustrates an alternative version of the muffler/deflector 10 having a tapered outlet 22.

The cap second end 23 and the body second end 15 are adapted to be connected via a snap-coupling. In the second embodiment of the present invention, the cap second end 23 defines a plurality of locking tabs 58 and the body second end 15 defines a locking slot 60 adapted to receive the locking tab 58. As illustrated in the sectional view of FIG. 6, the cap second end 23 deflects over the body second end 15 until the locking tabs 58 engage the locking slot 60. The deflection of the cap second end 23 over the body second end 15 is facilitated by a plurality of relief slots 62 extending through the cap second end 23. The relief slots 62 allow the cap 20 to deflect without permanent deformation. An acoustic pad 80 is situated within the passageway 26 to muffle sound.

Figure 7:
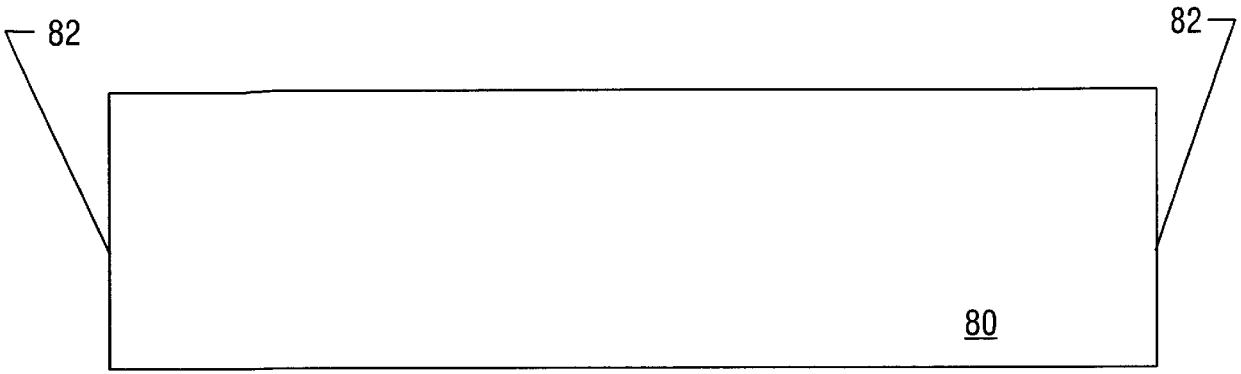
FIG. 7 illustrates an exemplary acoustical pad, prior to being rolled into a tube, in accordance with the second embodiment of the present invention.
Figure 8:
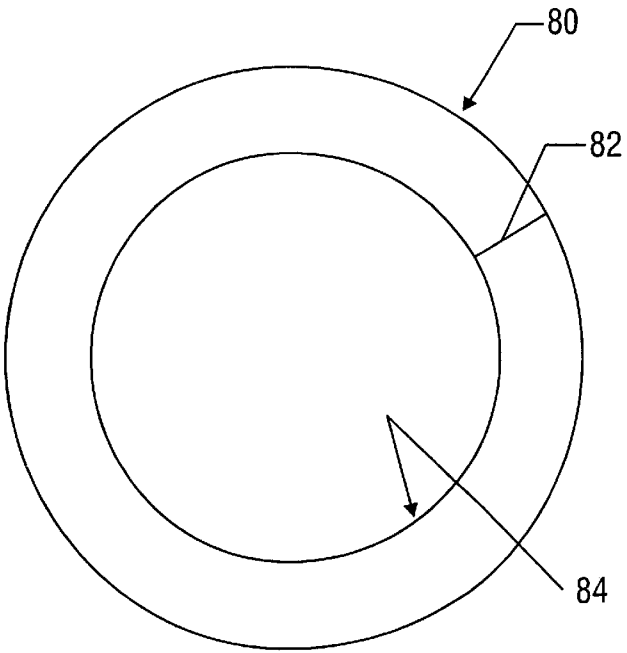
FIG. 8 illustrates the acoustical pad of FIG. 7 rolled into a tube shape in accordance with the second embodiment of the present invention.
Figure 9:
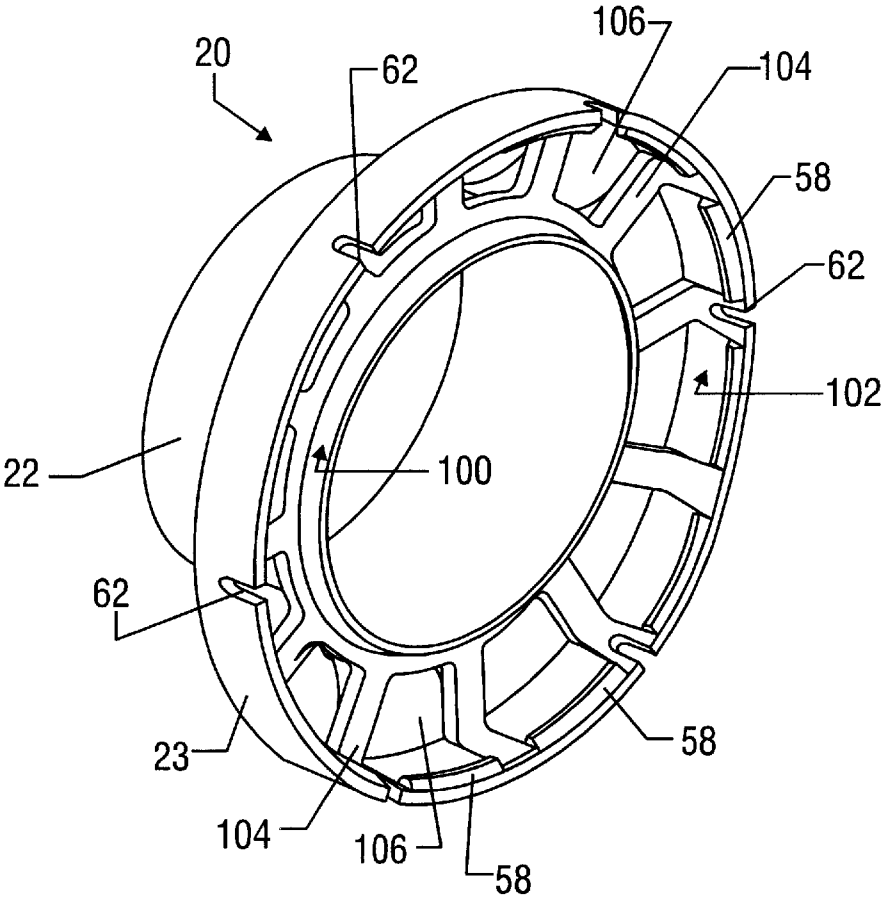
FIG. 9 is a perspective view of a cap member in accordance with the second to embodiment of the present invention.

The acoustic pad 80, illustrated in FIG. 7 and FIG. 8, is generally rectangular-shaped, and may comprise one-half inch open cell polyether having a density of 1.9 pounds per cubic foot. During assembly of the muffler/deflector 10 in accordance with the second embodiment of the invention, the acoustic pad 80 is simply rolled into a tube, such that the ends 82 of the acoustic pad 80 are in a generally abutting relationship, and inserted into the body second end 15. Once the acoustic pad 80 is rolled into a tube, it defines a smooth inner bore 84. Thus, only a single piece of acoustic foam is required, and there are no complicated cutting processes required (beyond establishing the initial rectangular shape of the acoustic pad 80), or the wasted material associated with cutting processes.

The body second end 15 defines a channel 86 in which a portion of the acoustic pad 80 seats. The channel 86 is defined by inner and outer concentric walls 88, 90. The outer wall 90 is longer than the inner wall 88; thus, a first portion 92 of the acoustic pad (rolled into a tube) is seated in the channel 86 and a second portion 94 is exposed to air flowing through the passageway 26. In a similar fashion, the cap second end 23 defines a channel 96 adapted to receive a third portion 98 of the acoustic pad 80 opposite the first portion 92. The channel 96 is defined by inner and outer concentric walls 100, 102, with the inner wall 100 sized so only the third portion 98 of the acoustic pad 80 is seated within the channel 96, allowing the second portion 94 to be exposed to the passageway 26. In a particular embodiment, the length of the inner walls 88, 100 are configured such that the second portion 94 of the acoustic pad 80 is about 1.4 inches long. In other words, about 1.4 inches of the pad 80 is exposed to the air flow through the passageway 26.

The configuration of the channels 86, 96 facilitates a very simple assembly process. The assembly step of rolling the acoustic pad 80 into a tube does not require significant precision or a complicated procedure. The acoustic pad 80 only needs to be rolled into a rough tube-shape, and then inserted into the channel 86 in the body 12. The cap 20 is then snapped onto the body 12, seating the third portion 98 of the acoustic pad 80 into the channel 96. The channels 86, 96 function to "true-up" the acoustic pad 80 into a tube-shape and align the butted ends 82. The inner walls 88, 100 of the channels 86, 96, respectively, are angled to even further assist in the acoustic pad 80 insertion and truing.

Moreover, the body first end 14, the inner wall 83, the inner wall 100, and the outlet 22 each define approximately equal inside diameters. As the inner walls 88, 100 hold the acoustic pad 80 within the channels 86, 96, the second portion 94 of the acoustic pad 80 does not extend into the passageway 26 and restrict airflow therethrough. A floor 104 of the channel 96 defines a plurality of openings 106 therethrough to expose the acoustical pad 80 outside the muffler/deflector 10, assisting in noise reduction by allowing "sound wave filtered" air to pass through the openings 106. A plurality of ribs 108 structurally reinforce the channel floor 104 adjacent the openings 106.

The second embodiment of the muffler/deflector 10 was also tested with wet/dry vac machines having blower ports. Sound levels were checked with the wet/dry vac inlet wide open and with the inlet blocked (blocked suction). With the muffler/deflector 10 in accordance with the second embodiment coupled to the blower port, significant sound reduction was achieved while only minimally reducing air flow. In addition to reducing sound power, the muffler/air deflector 10 also absorbs and reduces some of the irritating pitches, making the sound of the vacuum cleaner more tolerable.

The second embodiment of the muffler/deflector 10 was also tested with wet/dry vac machines having blower ports. Sound levels were checked with the wet/dry vac inlet wide open and with the inlet blocked (blocked suction). With the muffler/deflector 10 in accordance with the second embodiment coupled to the blower port, significant sound reduction was achieved while only minimally reducing air flow. In addition to reducing sound power, the second embodiment of the muffler/air deflector 10 also absorbs and reduces some of the irritating pitches, making the sound of the vacuum cleaner more tolerable.

Thus, the present invention provides a single vacuum cleaner accessory that performs the dual functions of reducing the irritating noise of a vacuum cleaner and directing discharge air from a blowing port. These functions are both accomplished by a compact unit including only three pieces that are configured for simple and inexpensive assembly. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A muffler and air deflector apparatus for a vacuum cleaner, comprising:

a body having first and second ends, the first end adapted to be coupled to a blower port of a vacuum cleaner;

a cap having first and second ends, the first end defining a tapered outlet, the second end being coupled to the second end of the body such that the body and the cap define a passageway for directing air from the blower port to the outlet, wherein the body is arranged such that the passageway defines a nonlinear passage from the blower port to the outlet; and a muffling device situated in the passageway.

2. The muffler and air deflector apparatus of claim 1 wherein the body includes an elbow.

3. The muffler and air deflector apparatus of claim 2 wherein the elbow defines an angle of about 45°.

4. The muffler and air deflector apparatus of claim 1 wherein the body is substantially rigid.

5. The muffler and air deflector apparatus of claim 1 wherein the first end of the body is adapted to be rotatably coupled to the blower port, such that the muffler and air deflector apparatus may be rotated about the blower port, allowing the air to be deflected in a desired direction.

6. The muffler and air deflector apparatus of claim 1 wherein the cap second end and the body second end are adapted to be coupled together via a snap-fit.

7. The muffler and air deflector apparatus of claim 6 wherein the cap second end and the body second end are adapted to be coupled together in any rotational orientation with respect to each other.

8. The muffler and air deflector apparatus of claim 6 wherein at least a portion of the cap second end is adapted to be deflected over the body second end, and wherein the cap second end defines at least one relief opening therein for allowing the cap second end to deflect without being permanently deformed.

9. The muffler and air deflector apparatus of claim 1 wherein the body and the cap are adapted to hold the sound muffling device in a fixed position.

10. The muffler and air deflector apparatus of claim 1 wherein the muffling device comprises a divider defining an axial opening therethrough, the divider being seated within the passageway such that the passageway and the divider define at least one sound wave reflecting chamber.

11. The muffler and air deflector apparatus of claim 1 wherein the muffling device comprises an acoustic pad seated within the passageway.

12. A muffler and air deflector apparatus for a vacuum cleaner, comprising:

a body having first and second ends, the first end adapted to be coupled to a blower port of a vacuum cleaner;

a cap having first and second ends, the first end defining an outlet, the second end being coupled to the second end of the body such that the body and the cap define a passageway for directing air from the blower port to the outlet; and a divider seated within the passageway such that the passageway and the divider define first and second sound wave reflecting chambers, the first chamber located generally within the body, the second chamber located generally within the cap.

13. The muffler and air deflector apparatus of claim 12 wherein the body first end defines a flange extending into the body second end.

14. The muffler and air deflector apparatus of claim 12 wherein the outlet is generally funnel shaped.

15. The muffler and air deflector apparatus of claim 12 wherein the cap second end and the body second end are adapted to be coupled together in any rotational orientation with respect to each other.

16. The muffler and air deflector apparatus of claim 12 wherein the divider includes a cylindrical flange defining a bore generally coaxial with the cap, and wherein at least part of the cylindrical flange extends into the cap.

17. The muffler and air deflector apparatus of claim 16 wherein the divider further defines a shoulder, and wherein at least a portion of the shoulder is captured between the cap second end and the body second end.

18. The muffler and air deflector apparatus of claim 17 wherein the divider further defines a rib extending generally opposite the cylindrical flange configured such that the rib will not fit into the second end of the cap.

19. The muffler and air deflector apparatus of claim 12 wherein:

the cap defines a channel about the periphery of the cap second end having inner and outer concentric walls, the outer wall defining at least one locking tab;

the body defines a locking slot about the periphery of the body second end; and the body second end is seated in the channel such that the locking tab is engaged with the locking slot to couple the body and the cap together.

20. A muffler and air deflector apparatus for a vacuum cleaner, comprising:

a body having first and second ends, the first end adapted to be coupled to a blower port of a vacuum cleaner;

a cap having first and second ends, the first end defining an outlet, the second end coupled to the second end of the body such that the body and the cap define a passageway for directing air from the blower port to the outlet; and a generally rectangular-shaped acoustic pad, the acoustic pad being rolled into a tube defining a smooth inner bore, the tube being situated axially within the passageway.

21. The muffler and air deflector apparatus of claim 20 wherein the outlet is generally cylindrical.

22. The muffler and air deflector apparatus of claim 20 wherein the cap second end and the body second end are adapted to be coupled together in any rotational orientation with respect to each other.

23. The muffler and air deflector apparatus of claim 20 wherein the body second end defines a channel adapted to receive at least a portion of the acoustic pad.

24. The muffler and air deflector apparatus of claim 23 wherein the channel is defined by inner and outer concentric walls, and the outer wall being longer than the inner wall such that a first portion of the acoustic pad is seated in the channel and a second portion is exposed to air flowing through the passageway.

25. The muffler and air deflector apparatus of claim 24 wherein the length of the inner wall is adapted such that at least 1.4 inches of the pad is exposed to the air flow.

26. The muffler and air deflector apparatus of claim 24 wherein the body first end defines an inside diameter, and the channel inner wall defines an inside diameter approximately equal to the first end inside diameter to prevent the acoustic pad from extending into the passageway and restricting airflow through the passageway.

27. The muffler and air deflector apparatus of claim 20 wherein the cap second end defines a channel adapted to receive at least a portion of the acoustic pad.

28. The muffler and air deflector apparatus of claim 27 wherein the channel is defined by inner and outer concentric walls, and wherein the inner wall is adapted such that at least a portion of the pad is exposed to the air flow.

29. The muffler and air deflector apparatus of claim 28 wherein the length of the inner wall is adapted such that at least 1.4 inches of the pad is exposed to the air flow.

30. The muffler and air deflector apparatus of claim 28 wherein the cap first end defines an inside diameter, and the channel inner wall defines an inside diameter approximately equal to the first end inside diameter to prevent the acoustic pad from extending into the passageway and restricting airflow through the passageway.

31. The muffler and air deflector apparatus of claim 20 wherein the cap second end defines at least one locking tab and the body second end defines a locking slot adapted to receive the locking tab to couple the cap and body together.

32. The muffler and air deflector apparatus of claim 20 wherein the cap defines at least one opening therethrough, the opening adapted to expose the acoustical pad to the environment outside the passageway.

33. The muffler and air deflector apparatus of claim 20 wherein the acoustical pad is fashioned out of open cell polyether.

34. A muffler and air deflector apparatus for a vacuum cleaner, comprising:

a body having a first end adapted to be coupled to an outlet blower port of the vacuum cleaner, and a second end;

a cap having a first end defining an outlet for directing air received from the outlet blower port, and a second end coupled to the second end of the body; and first means for reflecting sound waves to reduce noise generated by the vacuum cleaner.

35. The muffler and air deflector apparatus of claim 34 wherein the body and the cap define a passageway, the muffler and air deflector apparatus further comprising second means for fixing the first means within the passageway.

36. A muffler and air deflector apparatus for a vacuum cleaner, comprising:

a body having first and second ends, the first end adapted to be coupled to a blower port of a vacuum cleaner;

a cap having first and second ends, the first end defining a tapered outlet, the second end being coupled to the second end of the body via a snap-fit such that the body and the cap define a passageway for directing air from the blower port to the outlet; and a muffling device situated in the passageway.

37. A muffler and air deflector apparatus for a vacuum cleaner, comprising:

a body having first and second ends, the first end adapted to be coupled to a blower port of a vacuum cleaner;

a cap having first and second ends, the first end defining an outlet, the second end being coupled to the second end of the body such that the body and the cap define a passageway for directing air from the blower port to the outlet;

a divider seated within the passageway, the divider defining a bore therethrough and including an annular shoulder portion that defines a plane oriented generally transverse to the axis of the bore; and a sound reflecting chamber defined by the shoulder portion and the body second end.

38. The muffler and air deflector apparatus of claim 37, wherein the body first end defines a flange extending into the body second end, and wherein the flange further defines the sound reflecting chamber.

39. A muffler and air deflector apparatus for a vacuum cleaner, comprising:

a body having first and second ends, the first end adapted to be coupled to a blower port of a vacuum cleaner;

a cap having a first end defining an outlet and an annular inside surface oriented generally transverse to the axis of the outlet;

the cap having a second end being coupled to the second end of the body such that the body and the cap define a passageway for directing air from the blower port to the outlet;

a divider seated within the passageway, the divider defining a bore therethrough and including a flange extending into the cap second end; and a sound reflecting chamber defined by the annular inside surface of the cap first end, the cap second end, and the flange.

* * * * *